United States Patent [19]

Hurko

[11] 4,150,280

[45] Apr. 17, 1979

[54] HIGH EFFICIENCY FREE EXPANSION FOIL HEATING ELEMENT

[75] Inventor: Bohdan Hurko, Louisville, Ky.

[73] Assignee: General Electric Company, Louisville, Ky.

[21] Appl. No.: 784,604

[22] Filed: Apr. 4, 1977

[51] Int. Cl.[2] ..... H05B 3/68

[52] U.S. Cl. ..... 219/461; 338/307; 338/308; 338/314; 219/463; 219/464; 219/543; 219/544

[58] Field of Search ..... 219/461, 462, 463, 464, 219/467, 543, 544, 460; 338/306–309; 29/611, 620

[56] References Cited

U.S. PATENT DOCUMENTS

| | | | |
|---|---|---|---|
| 2,152,126 | 3/1939 | Young | 219/460 |
| 3,067,315 | 12/1962 | Hurko | 219/543 |
| 3,086,101 | 4/1963 | Scofield | 219/460 |
| 3,591,753 | 7/1971 | Gartner | 219/464 |
| 3,733,462 | 5/1973 | Bouchard et al. | 219/464 |
| 3,805,024 | 4/1974 | Joeckel et al. | 219/464 |
| 3,845,273 | 10/1974 | Hurko | 219/464 |
| 3,869,596 | 3/1975 | Howie | 219/464 |
| 3,968,281 | 7/1976 | Erikson | 219/460 |
| 4,032,750 | 6/1977 | Hurko | 219/464 |

FOREIGN PATENT DOCUMENTS

| | | | |
|---|---|---|---|
| 2506931 | 2/1976 | Fed. Rep. of Germany | 219/464 |

*Primary Examiner*—J. V. Truhe
*Assistant Examiner*—M. Paschall

[57] ABSTRACT

A flat plate surface heating unit or cooktop having a solid utensil-supporting plate that is heated by a resistive foil heating element that is bonded to a flexible, ceramic fiber paper substrate by a high temperature inorganic cement of high thermal conductivity and high electrical resistivity. The cement is formed in an electrically insulating layer that overlies the foil, and this cement hardens before the cement surface is applied against the underside of the cover plate so that the cement is not bonded to the cover plate. The soft, fibrous nature of the ceramic fiber paper substrate allows free expansion of the foil during thermal cycling. The relatively high thermal conductivity layer provides good heat transfer from the foil heating element to the utensil-supporting plate for improved efficiency.

7 Claims, 4 Drawing Figures

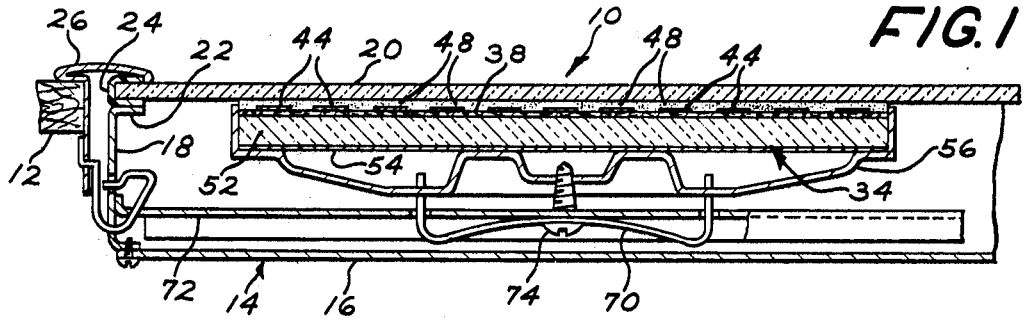
FIG. 1
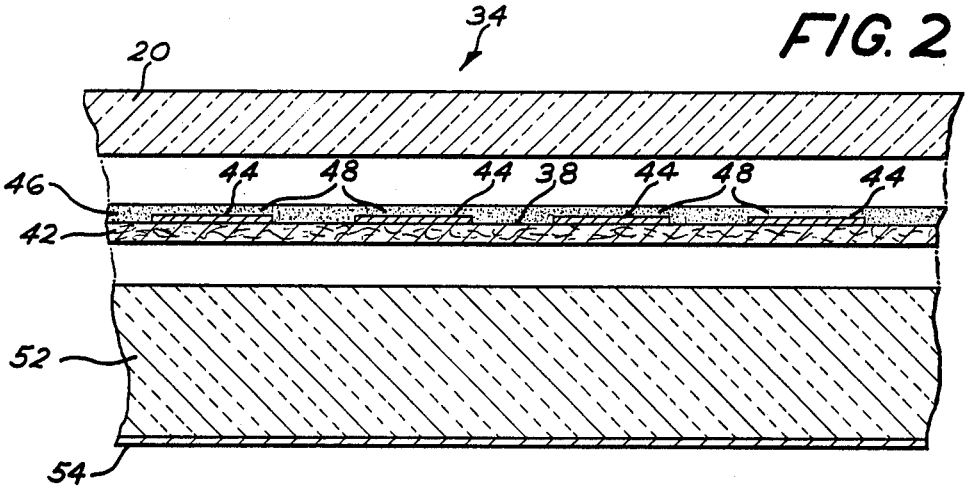
FIG. 2
FIG. 4
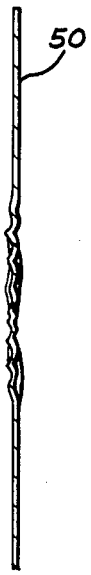
FIG. 3
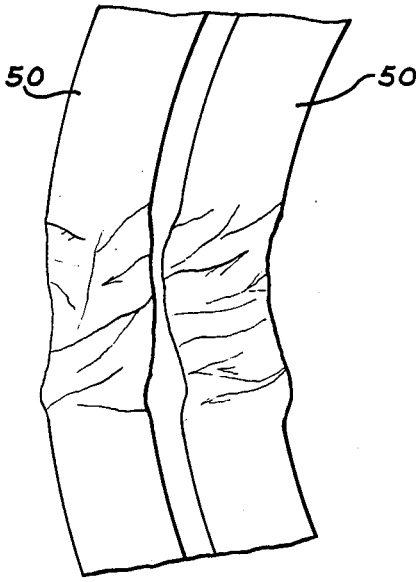
PRIOR ART

HIGH EFFICIENCY FREE EXPANSION FOIL HEATING ELEMENT

CROSS-REFERENCE TO RELATED APPLICATION

This application is an improved modification of my copending patent application Ser. No. 670,702 which was filed Mar. 26, 1976, and entitled "Flat Plate Heating Unit With Foil Heating Means," now U.S. Pat. No. 4,032,750, which is also assigned to the assignee of the present invention. The present invention employs an improved flexible substrate for the foil heating element, as well as an improved inorganic cement.

BACKGROUND OF THE INVENTION (1) Field Of The Invention:

This invention relates to the electric cooking art and particularly to the use of etched foil heaters with a solid utensil-supporting cover plate.

(2) Description Of The Prior Art:

Solid plate surface heating units and cooktops have been proposed with high temperature glass-ceramic plates having film heaters of noble metal bonded directly to the underside of the plates. Three examples of glass-ceramic heating units using film heaters are shown in the two prior Hurko Pat. Nos. 3,067,315 and 3,883,719, both of which are assigned to the present assignee, and in the Brouneus Pat. No. 3,813,520. Such film heaters are of serpentine shape, and they are bonded directly to the plate. They provide a most efficient heating system for glass-ceramic surface heating units or cooktops because the film strips have a very low thermal mass and good thermal coupling with the plate, resulting in quick response to heat-up and cool-down conditions. The film heater stores very little heat, and it radiates very little heat in a downward direction because of its low emissivity surface. One deterrent to the use of the film heater designs for solid plate surface heating units is the relatively high cost of film materials because they are of noble metals, such as gold and platinum.

Etched foil heaters for use with solid plate surface heating means at low temperatures below about 450° F. have been available from Safeway Products, Inc., of Middletown, Conn. Such foil heaters are highly reliable at relatively low temperatures, and their cost is a great deal below film heaters. An example of etched foil heaters is given in the Howie Pat. No. 3,869,596, which is assigned to Safeway Products, Inc. This patent shows a glass-ceramic plate with an etched foil heater bonded between two layers of dielectric material, and this laminated heating element is bonded directly to the underside of the glass-ceramic plate. As stated in this Howie patent, it has an anticipatd maximum operating temperature on the order of 450° F.

This bonding action of the laminated foil heating element directly to the cover plate is a deterent because it limits the kind of foil material that may be used to a low thermal expansion metal foil so as to be able to match the coefficient of thermal expansion of the glass-ceramic plate, and this in turn limited the application of etched foil heaters to a relatively low temperature range having a maximum of about 450° F. Moreover, prior art foil heaters used a flexible, thermosetting organic adhesive to make a strong bond, which again limited the foil heater to low temperature applications. At higher temperatures, such adhesive would carbonize and cause short circuits between the adjacent turns of the foil heater as was experienced during testing of the prior art devices.

The before mentioned U.S. Pat. No. 4,032,750 of the present inventor, describes an etched foil heater that is separate from the utensil-supporting cover plate and is for use at high temperatures in the vicinity of 1250° F. That prior design had means to allow the resistive foil heater to freely expand at operating temperatures with relation to its supporting laminations of insulation. That prior design also utilized a high temerature inorganic binder for bonding the resistive foil heater to the dielectric substrate. The dielectric substrate was positioned directly against the underside of the cover plate but not bonded thereto, and the resistive foil means was adhesively bonded to the underside of the dielectric layer. The preferred embodiment of this prior heating unit had a second dielectric substrate bonded to the underside of the resistive foil means as well as to the first dielectric layer to form a flexible, laminated heating element.

The principal object of the present invention is to provide a solid plate surface heating unit with a separate, flexible, insulated foil heater for use at high temperatures in the vicinity of 1250° F., where the foil is free to expand with a ceramic fiber paper substrate during thermal cycling of the heater.

A further object of the present invention is to provide a solid plate surface heating unit of the class described using an inorganic cement having high thermal conductivity and high electrical resistivity so as to provide increased heat flow toward the utensil-supporting cover plate.

SUMMARY OF THE INVENTION

The present invention, in accordance with one form thereof, relates to a flat plate surface heating unit having an uppper utensil-supporting cover plate and a resistive foil heating element carried by a flexible substrate of ceramic fiber paper and bonded thereto by a high temperature inorganic cement. This inorganic cement has a high thermal conductivity and high electrical resistivity, and it forms an electrical insulating layer over the top surface of the foil heating element, and the cement is in direct contact with the underside of the cover plate but not bonded thereto. A support means of dielectric material is positioned beneath the ceramic fiber paper substrate, and constant pressure is furnished to supply a compressive force to assure good thermal coupling of the resistive foil heating element with the cover plate.

BRIEF DESCRIPTION OF THE DRAWINGS

This invention will be better understood from the following description taken in conjunction with the accompanying drawings and its scope will be pointed out in the appended claims.

FIG. 1 is a fragmentary, cross-sectional elevational view through one side of a glass-ceramic cooktop which incorporates an etched foil heating element of the present invention.

FIG. 2 is a fragmentary, exploded view in cross-section on an enlarged scale of a portion of the cover plate showing the etched foil heater supported on a ceramic fiber paper substrate and bonded thereto by an inorganic cement, where the cement forms an insulating layer that overlies the foil heater. This cement is to be in direct contact with the underside of the glass-ceramic cover plate, but is not bonded thereto. A support pad of dielectric material underlies the ceramic fiber paper substrate.

FIG. 3 is an enlarged, fragmentary plan view of two adjacent turns of an etched foil heater element of the prior art where the foil has wrinkled during theremal cycling, which may occur in the event the foil heater becomes permanently fixed to the substrate at two spaced points so that the immediate portion of the foil heater between the two spaced points would be restricted from free expansion and hence the intermediate portion would break away from the substrate and assume a wrinkled configuration that may shift sideways, and cause hot spots to form and eventual premature failure.

FIG. 4 is a side view of one of the wrinkled foil heater segments of FIG. 3.

DESCRIPTION OF THE PREFERRED EMBODIMENT

Turning now to a consideration of the drawings, and in particular to FIG. 1, there is shown a portion of an electrically heated glass-ceramic cooktop 10 that is built into a kitchen countertop 12. It will be understood that this invention of a novel etched foil heater element could also be used in a solid plate cooktop assembled over the oven of an electric range, or used in a single surface heating unit or hotplate. The cooktop 10 has a shallow, metal mounting box or rough-in box 14 with a bottom wall 16, vertical side walls 18 and an open top which is adapted to be closed by a thin, utensil-supporting, glass-ceramic plate 20. The plate 20 may be a single large plate for accommodating four surface heating units, or a series of either two medium-sized, double plates or four smaller individual plates. Such glass-ceramic plate material is crystalline glass that is generally opaque, of lithia-alumina silicates having a very low coefficient of thermal expansion. Examples of such material are sold under such trademarks as PYROCERAM, CER-VIT, and HERCUVIT. Of recent orgin are dark-tinted glass-ceramic plates which are semi-transparent to visible part of radiant energy and which render open coil heaters visible when the heaters are energized.

This glass-ceramic plate 20 has a smooth top surface and is readily cleanable. The plate does not permit the drainage of spillovers therebeneath as occurs in standard cooktops using spiral coils of metal sheathed electric resistance heating elements. While the glass-ceramic plate 20 is shown, it will be understood by those skilled in this art, that such a solid plate could be of metal or other high temperature resisting material without departng from the scope of the present invention.

First, to explain some of the environment in which the foil heating element of the present invention would be incorporated. A peripheral ledge or flange 22 is formed around the top edge of the vertical walls 18 of the rough-in box 14, and it serves as a support means for the edge of the glass-ceramic plate 20. There may be other support ledges near the center of the box, as needed. The peripheral edge of the glass-ceramic plate 20 is provided with a resilient, wrap-around gasket 24 for protecting the edge and serving as a resilient seat and moisture barrier. A trim frame 26, of T-shaped transverse cross-section, encircles the periphery of the box 14 and serves as the support means for the box in an opening cut out of the countertop 12, as is conventional in this art.

The cooktop 10 may have a plurality of heating means. The number of four is more or less standard in the electric range art in the United States. For the purpose of illustrating the present invention, only one surface heating unit 34 is shown, as in FIG. 1. The surface unit 34 has a heating means 38 in the form of a thin, flexible, dielectric sheet 42 supporting an etched, resistive foil heater 44, as is best seen in FIG. 2. The thin dielectric sheet 42 is preferably a soft, ceramic fiber paper having a thickness between about 1/32" and ⅛". The resistive foil heater 44 would be of coiled configuration, and preferably a spiral coil that is adhesively bonded by an inorganic cement 46 to the substrate 42. Preferably, the inorganic cement 46 would be spread over the top of the foil heater element 44 and fill the space between adjacent turns as well as form an insulating layer on top of the foil heater, as at 48.

Suitable inorganic binders may include sodium, potassium, or aluminum silicates, which are capable of withstanding temperatures having a maximum limit in the vicinity of 1250° F. A preferred embodiment of inorganic cement would include a binder with magnesium oxide or zircon powder that have high thermal conductivity as well as high electrical resistivity so as to deliver the heat energy to the glass-ceramic cover plate 20, while at the same time insulating the cover plate 20 from electrical leakage. Due to the relatively higher thermal conductivity of the inorganic cement layer 48, more heat is delivered through the layer 48 to the glass ceramic plate 20 than is lost through the soft fiber paper 42, which has thermal insulating qualities. Higher thermal efficiency results.

A primary advantage of the present invention is due to the use of the ceramic fiber paper substrate 42, which is sold under the trademark "Fiberfrax" by The Carborundum Company of Niagara Falls, New York. This ceramic fiber paper has a continuous use limit of about 2300° F. and a melting point of about 3260° F. It has a density of ten to twelve lbs. per cubic foot and a dielectric strength of 100 V. per mil. Ceramic paper was mentioned in passing in the earlier copending patent application Ser. No. 670,702, as a possible alternate material for the dielectric sheets. This present application represents an improved modification of the earlier invention which had as its preferred embodiment Micamet sheets of insulation, that are somewhat stiff and brittle in texture as compared with the ceramic fiber paper 42 of the present invention which has a soft cushion texture and a plurality of fibers which are able to shift with respect to each other and thereby not exert a positive holding force with respect to the foil heater 44 which would otherwise permit wrinkling of the foil during thermal cycling as is depicted in FIGS. 3 and 4.

In the present invention during thermal cycling, the foil heater may expand and contract throughout its longitudinal length without causing wrinkles of the type as is depicted in FIGS. 3 and 4. In the case of the prior art of FIGS. 3 and 4, if the foil heater 50 were to become wrinkled, the foil would separate from the supporting substrate and also from good thermal coupling with the glass-ceramic plate 20. In such an event, the glass-ceramic plate would not serve as a heat sink and draw off the heat energy from the wrinkled portion of the foil heater and thus the heater would become overheated. Hot spots may form which bring about premature failure. This also may cause the adjacent turns of the foil heater to shift sideways and eventually touch each other and cause a short circuit and arcing. The fibrous substrate 42 of the present invention would not present any resistance to the expansion of the foil heater 44; therefore, the wrinkling of the foil as shown in FIGS. 3 and 4 could not occur with the present invention.

The foil heater 44 is a thin foil on the order of 0.002 inches, etched from stainless steel or Nichrome foil in a spiral coil configuration, similar to those used with film heaters. The inorganic cement 46 is bonded to the foil heater 44 and to the ceramic fiber paper substrate 42. Later, this subassembly is pressed against the underside of the glass-ceramic plate 20, but the inorganic cement 46 has first been allowed to set. It would not be tacky and would not be bonded to the underside of the glass-ceramic plate.

The substrate 42 is supported on a thick pad of dielectric material 52 of high insulating quality, such as Microtherm. A reflective foil 54 is placed across the underside of the pad 52 for directing the heat energy in an upward direction. This insulating pad 52 is seated in a reinforced, metal reflector pan 56 which is generally of a cylindrical shape. The bottom of the reflector pan is embossed to give it rigidity so it will not have an "oil can" effect at high operating temperatures, but wll be generally rigid. The purpose of the pan is to support the dielectric pad 56 and exert a constant upward pressure against the heating means 34 to hold the heating means tightly against the underside of the cover plate 20. This all must be done at relatively high temperatures, when the heater may operate as high as 1250° F., and there would otherwise be a tendency for the metal to expand and contract due to variations in temperatures.

It is well to exert a constant upward pressure against the heating means 34 through the dielectric pad 52 and the reflector pan 56, because the cover plate 30 serves as a heat sink and draws off heat from the heating means. If there were a poor thermal coupling between the heating means and the cover plate, there could be local overheating of the heating means, poor thermal efficiency and a shortened life of the foil heater. The upward pressure is provided by a leaf spring 70 which is fastened to a brace or rail 72 that is supported in the rough-in box 14. A fastening screw 74 extends through the center portion of the spring and is threaded into an opening in the rail.

The electrical terminals for the foil heater 44 are not shown because they would be conventional, and are not a critical part of the present invention.

Modifications of this invention will occur to those skilled in this art; therefore, it is to be understood that this invention is not limited to the particular embodiment disclosed, but that it is intended to cover all modifications which are within the true spirit and scope of this invention as claimed.

What is claimed is:

1. A flat plate surface heating unit comprising: an upper utensil-supporting cover plate of heat-conductive material.

a heating means including:

a flexible dielectric substrate of ceramic fiber paper.

a resistive foil heating element carried by said flexible substrate of ceramic fiber paper and bonded thereto by a lazer of high temperature inorganic cement, and said layer of inorganic cement having high thermal conductivity and high electrical resistivity and being formed over the top surface of said foil heatig element;

said organic cement layer of said heating means being in direct contact with the underside of said cover plate, but not bonded thereto;

a support pad of dielectric, non-thermal-conductive material positioned beneath the ceramic fiber paper substrate; and a reflector pan firmly supporting the dielectic pad;

pressure means supported with respect to the cover plate and applying upward pressure to the dielectic pad to assure good thermal coupling of the resistive foil heating element with the cover plate.

2. The invention of claim 1 wherein the high temperature, inorganic cement comprises a mixture of magnesium oxide powder and inorganic cement so as to provide good thermal flow to the cover plate while preventing current leakage to the cover plate.

3. The invention of claim 1 wherein the high temperature, inorganic cement comprises a mixture of magnesium oxide and colloidal silica so as to provide good thermal flow to the cover plate while preventing current leakage to the cover plate.

4. The invention of claim 1 wherein the high temperature inorganic cement is selected from one of the group of sodium, potassium and aluminum silicates, and it includes a filler selected from one of the group of magnesium oxide and zircon to obtain the high thermal conductivity and high electrical resistivity.

5. The invention of claim 4 wherein the inorganic cement only fills in between adjacent turns of the foil heating element and also forms the said electrical insulating layer over the top surface of the foil heating element so as to prevent electrical leakage to the cover plate.

6. The invention of claim 1 wherein the thickness of said resistive foil heating element is in the order of 0.002 inch.

7. The invention of claim 6 wherein the thickness of the dielectric substrate is within the range from about 1/32 inch to ⅛ inch.

* * * * *